US007051789B2

(12) United States Patent
Sheppard

(10) Patent No.: US 7,051,789 B2
(45) Date of Patent: May 30, 2006

(54) TWO-PIECE MOUNTING BRACKET FOR HEAT EXCHANGER

(75) Inventor: Jeff Sheppard, Milton (CA)

(73) Assignee: Dana Canada Corporation, Oakville, Ontario (CA)

( * ) Notice: Subject to any disclaimer, the term of this patent is extended or adjusted under 35 U.S.C. 154(b) by 57 days.

(21) Appl. No.: 10/829,534

(22) Filed: Apr. 22, 2004

(65) Prior Publication Data

US 2005/0236140 A1 Oct. 27, 2005

(51) Int. Cl.
*F28F 9/07* (2006.01)

(52) U.S. Cl. ..... 165/67; 165/149; 228/183

(58) Field of Classification Search ..... 165/67, 165/149; 180/68.4
See application file for complete search history.

(56) References Cited

U.S. PATENT DOCUMENTS

| | | | | |
|---|---|---|---|---|
| 1,246,325 | A | 11/1917 | Rohmer | |
| 3,113,615 | A * | 12/1963 | Huggins | 165/149 |
| 4,196,774 | A * | 4/1980 | Hoffmann | 165/67 |
| 4,258,785 | A | 3/1981 | Beldam | |
| 4,569,390 | A | 2/1986 | Knowlton et al. | |
| 4,938,284 | A * | 7/1990 | Howells | 165/149 |
| 5,058,662 | A | 10/1991 | Nguyen | |
| 5,069,275 | A | 12/1991 | Suzuki et al. | |
| 5,086,832 | A | 2/1992 | Kadle et al. | |
| 5,107,926 | A | 4/1992 | Calleson | |
| 5,183,103 | A | 2/1993 | Tokutake | |
| 5,205,349 | A | 4/1993 | Nagao et al. | |
| 5,407,161 | A * | 4/1995 | Mulkeran | 248/232 |
| 5,429,182 | A | 7/1995 | Hanafusa | |
| 5,487,422 | A | 1/1996 | Bertva et al. | |
| 5,535,819 | A * | 7/1996 | Matsuura | 165/149 |
| 5,570,737 | A | 11/1996 | Tokutake | |
| 5,692,559 | A | 12/1997 | Cheong | |
| 5,720,341 | A | 2/1998 | Watanabe et al. | |
| 5,791,402 | A | 8/1998 | Dumetz | |
| 5,899,263 | A | 5/1999 | Tokutake | |
| 5,947,196 | A | 9/1999 | Halm et al. | |
| 5,964,282 | A | 10/1999 | Seiler et al. | |
| 6,000,460 | A * | 12/1999 | Yamanaka et al. | 165/67 |

(Continued)

FOREIGN PATENT DOCUMENTS

CA 2405275 3/2003

(Continued)

OTHER PUBLICATIONS

U.S. Appl. No. 10/851,784, entitled Ribbed Mounting Bracket for Heat Exchangers filed May 21, 2004.

(Continued)

*Primary Examiner*—Allen J. Flanigan
(74) *Attorney, Agent, or Firm*—Ridout & Maybee LLP

(57) ABSTRACT

A mounting bracket for securing a component, including a unitary first bracket member including a first plate portion having a first section for securing to the component, a second plate portion having a second section for securing to the component, and an intermediate plate portion, the first and second plate portions being spaced apart from each other with the intermediate plate portion extending there between, the first, second and intermediate plate portions defining a central space there between; and a separately formed second bracket member mounted to the first bracket member and having a central portion extending at least partially across the central space, the bracket member including engagement members extending outward from the central portion and engaging the first bracket member thereby securing the second bracket member to the first bracket member, the central portion defining a mounting opening there through.

23 Claims, 6 Drawing Sheets

U.S. PATENT DOCUMENTS

| | | | | |
|---|---|---|---|---|
| 6,199,622 | B1 * | 3/2001 | Mashio et al. | 165/67 |
| 6,237,676 | B1 * | 5/2001 | Hasegawa et al. | 165/67 |
| 6,263,954 | B1 | 7/2001 | Nakayama | |
| 6,276,445 | B1 * | 8/2001 | Sasano et al. | 165/135 |
| 6,405,788 | B1 * | 6/2002 | Balthazard | 165/67 |
| 6,530,424 | B1 | 3/2003 | Jamison et al. | |
| 6,742,572 | B1 * | 6/2004 | Muhammad et al. | 165/67 |
| 2002/0056541 | A1 * | 5/2002 | Kokubunji et al. | 165/67 |
| 2003/0146030 | A1 | 8/2003 | Harada | |
| 2004/0261973 | A1 | 12/2004 | Kent et al. | |
| 2005/0006052 | A1 * | 1/2005 | Kozdras et al. | 165/67 |

FOREIGN PATENT DOCUMENTS

| | | |
|---|---|---|
| CA | 2069783 | 10/2003 |
| DE | 3215 961 | 11/1983 |
| DE | 4232019 | 10/1993 |
| EP | 1496270 | 1/2005 |
| FR | 2527325 | 11/1983 |
| FR | 2550618 | 2/1985 |
| FR | 2748559 | 11/1997 |
| JP | 3-164694 | 7/1991 |
| JP | 4288484 | 10/1992 |
| JP | 04288486 | 10/1992 |
| JP | 08159686 | 6/1996 |
| JP | 2002168589 | 6/2002 |

OTHER PUBLICATIONS

U.S. Appl. No. 10/851,785, entitled Vibration-Resistant Mounting Bracket for Heat Exchangers filed May 21, 2004.

International Search Report for PCT/CA2005/000612 mailed Aug. 15, 2005.

* cited by examiner 42
44
46
48
50
52
56
58
60
64
66
68
80
82
84
86
88
90
92

TWO-PIECE MOUNTING BRACKET FOR HEAT EXCHANGER

BACKGROUND

The present invention relates to stacked plate devices such as heat exchangers, and more particularly, to mounting brackets therefor. Heat exchanger cores are commonly formed from a plurality of thin, substantially flat tubes, stacked upon one another in spaced relation, which extend between a pair of spaced-apart manifolds or headers. The manifolds are often simply constructed from pipe, suitably perforated to receive the flat tubes. Exemplary of this construction is the heat exchanger core described in U.S. Pat. No. 5,183,103 (Tokutake), issued Feb. 2, 1993. However, it is also known to seal the ends of the tubes, and provide the tubes with bosses which, when the tubes are suitably stacked and connected together, by brazing or the like, mate with one another to form the manifolds. It is known to use welded tubes for this latter type of construction, and also to use tubes formed from pairs of formed plates, which are sealed together during the brazing process. U.S. Pat. No. 5,964,282 (Seiler et al.), issued Oct. 12, 1999, is exemplary of this latter construction.

For the purpose of mounting, i.e. within the engine compartment of a vehicle or the like, heat exchanger cores of the type comprising perforated pipe headers, it is known to braze a mounting bracket to the header or manifold. The mounting bracket usually includes a lug adapted to be secured to the vehicle frame. Preferably, the mounting bracket is provided with a portion which is capable of resiliently engaging the exterior of the header to keep the mounting bracket in place during the brazing process, so as to avoid the need for auxiliary clamping tools, which can add to cost and can absorb heat in a brazing oven, resulting in poor quality braze joints. The mounting brackets taught in U.S. Pat. No. 5,069,275 (Suzuki et al.), issued Dec. 3, 1991, are exemplary of this construction.

However, while this type of mounting bracket is known to be used in association with perforated-pipe type manifolds, it is not known to be used in association with paired-plate type heat exchanger cores having manifold-forming elements, such as that described in U.S. Pat. No. 5,964,282. In this latter type of heat exchanger, the core typically is provided with heavier gauge end plates with attached lugs, thereby to provide for mounting.

In some heat exchangers, the mounting bracket portion that defines the mounting hole is formed from braze-clad material, which can provide inconsistent mounting hole size subsequent to brazing. Prior mounting bracket configurations can also lack flexibility in terms of positioning outward from the side ends of the head exchanger, and in some cases be difficult to properly align during manufacture.

Accordingly, there is a need for a mounting bracket configuration that provides consistent and cost effective manufacturability and/or which allows the mounting bracket to be laterally positioned relative to side ends of the heat exchanger.

SUMMARY

According to one example embodiment of the invention there is provided a mounting bracket for a heat exchanger. The mounting bracket includes an elongate, generally flat plate, the plate having a planar central portion for mounting to a heat exchanger core, the plate being shaped at a first end of the planar central portion to form a first bracket member, the first bracket member extending from the planar central portion and having a distal end for engaging the heat exchanger at a location spaced apart from the planar central portion, the first bracket member at least partially surrounding an opening. The mounting bracket also includes a second bracket member separately formed from and mounted to the first bracket member, the second bracket member having a central plate portion extending at least partially across the opening that is at least partially surrounded by the first bracket member, the central plate portion defining a mounting opening there through.

According to another example embodiment there is provided a heat exchanger that includes a stacked tube core including a plurality of stacked elongate tubes each defining an internal fluid passage and having spaced apart inlet and outlet openings in communication with the internal fluid passage, the stacked tube core including an inlet manifold communicating with the inlet openings and an outlet manifold communicating with the outlet manifolds for providing for a flow of fluid through the tubes. The heat exchanger has a mounting bracket including (i) an elongate, generally flat mounting bracket plate mounted to the stacked tube core, the mounting bracket plate including a substantially planar central portion and being shaped at a first end of the planar central portion to form a first bracket member, the first bracket member extending from the planar central portion and having a distal end for engaging the stacked tube core at a location spaced apart from the first end of the planar central portion, the first bracket member partially surrounding a first bracket member area adjacent a side of the stacked tube core; and (ii) a second bracket member mounted to the first bracket member, the second bracket member having a central plate portion extending at least partially across the first bracket member area, the central plate portion having a mounting opening formed there through.

According to another example embodiment there is provided a mounting bracket for securing a component, including a unitary first bracket member including a first plate portion having a first section for securing to the component, a second plate portion having a second section for securing to the component, and an intermediate plate portion, the first and second plate portions being spaced apart from each other with the intermediate plate portion extending there between, the first, second and intermediate plate portions defining a central space there between; and a separately formed second bracket member mounted to the first bracket member and having a central portion extending at least partially across the C-shaped space, at least one of the second and first bracket members having engagement members for securing the second bracket member to the first bracket member. the central portion defining a mounting opening there through.

According to another example embodiment there is provided a method for forming a heat exchanger that includes steps of: providing a heat exchanger core including a plurality of braze clad stacked tube members; providing a braze clad generally planar bracket plate and connecting the bracket plate to the heat exchanger core, the bracket plate having a generally C-shaped first bracket member extending beyond an end of the heat exchanger core; providing a non-braze clad second bracket member having engagement members for engaging the first bracket member and connecting the engagement members to the first bracket member, the second bracket member including a central portion defining a mounting opening there through; and furnace brazing the second bracket member to the first bracket member.

BRIEF DESCRIPTION OF THE DRAWINGS

Example embodiments of the invention will now be described, with reference to the accompanying drawings, throughout which similar reference numbers are used for similar components and in which.

DESCRIPTION OF EXAMPLE EMBODIMENTS

Figure 1:
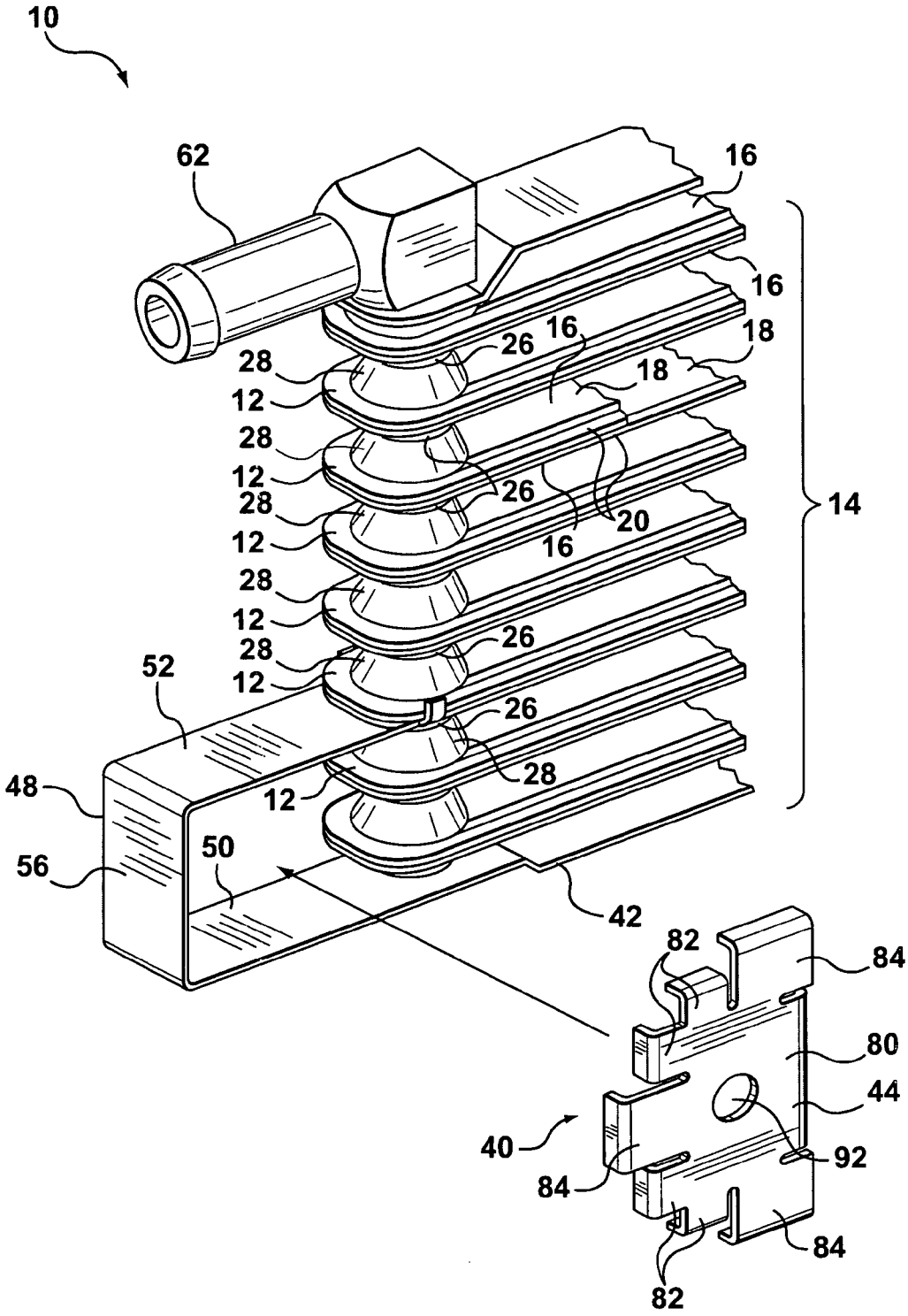
FIG. 1 is a perspective view of a portion of a heat exchanger having a mounting bracket according to an example embodiment of the invention.
Figure 2:
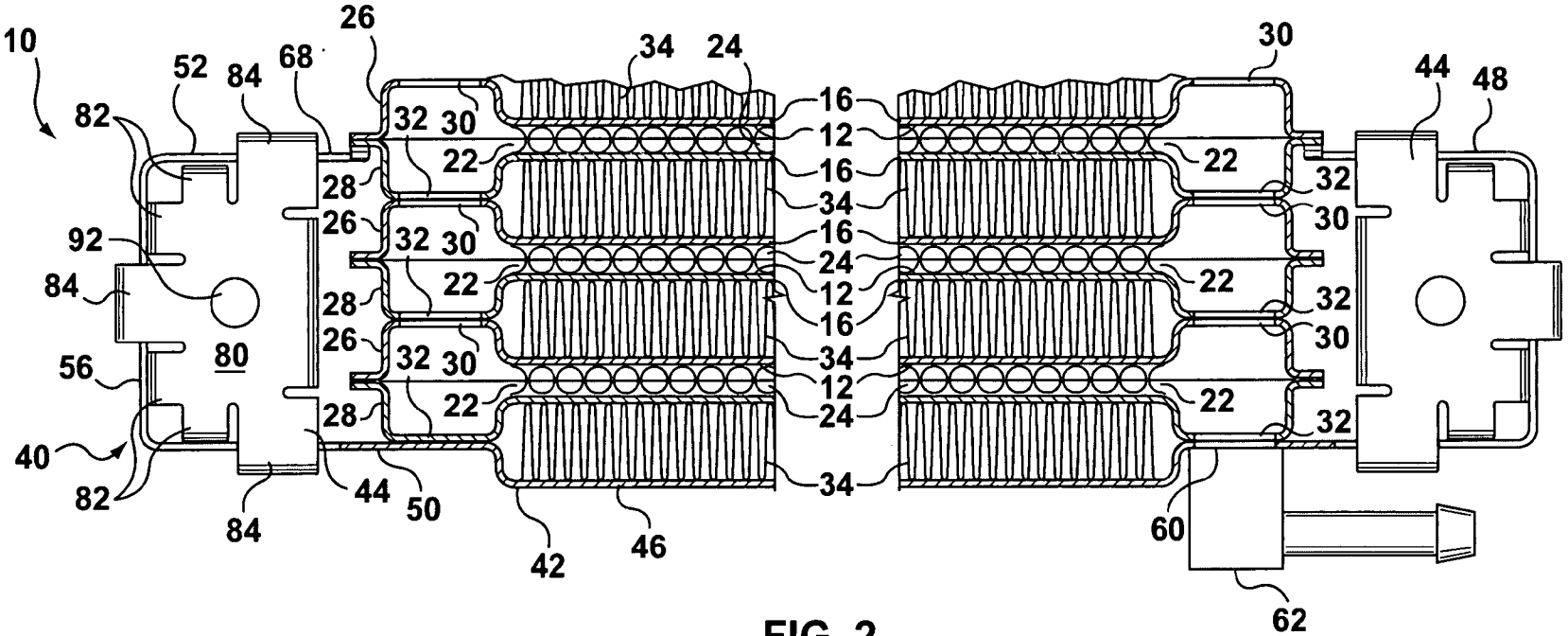
FIG. 2 is an elevational view, partially broken away, of a lower portion of the heat exchanger of FIG. 1.

Referring firstly to FIGS. 1 and 2, an example embodiment of a plate and fin heat exchanger is generally indicated by reference numeral 10. Heat exchanger 10 includes a heat exchanger stacked tube core 14 formed of a plurality of stacked, hollow tubes, which in an example embodiment are flat plate pairs 12 formed from elongate mating plates 16. Plates 16 have elongate planar central sections 18 surrounded by a peripheral edge portion 20. In each plate pair 12, the centre sections 18 are spaced apart and the plates 16 are sealably joined together about their peripheral edge portions 20 such that an internal flow channel 22 is defined between the centre sections 18. In some example embodiments, expanded metal turbulizers 24 are located in the flow channels 22, although in some embodiments turbulizers 24 may not be present or may be replaced by other structures such as dimples or ribs or other protrusions formed on the plates 16.

Each of the plate pairs 12 has mating end bosses 26, 28 located at opposite ends thereof. These end bosses have communicating openings 30, 32 and are aligned at respective ends of the core stack 14 to form inlet and outlet manifolds for the flow of fluid through the plate pairs. Some of the end bosses may not have openings therein, or these openings may be closed in other ways to provide a particular flow circuit inside the heat exchanger core.

Although not shown in FIG. 1, as best seen in FIG. 2, in an example embodiment the heat exchanger 10 includes fins 34 between each of the plate pairs 12, and on the top and bottom of the stacked tube core 14. The fins 34 extend between their respective end bosses 26, 28 located at the opposite ends of the plate pairs.

The exact configuration of plate pairs 16 or the tube equivalents, and fins 34 are not important to example embodiments of the invention. Any appropriate type of plate or tube and any type of fins can be used in heat exchanger 10. In some example embodiments, the fins 34 are all generally of the same height, and the end bosses 26, 28 are all generally of the same height. Although only a left portion of the heat exchanger 10 is shown in FIG. 1, in an example embodiment the right portion is substantially identical to the left.

The heat exchanger 10 includes a mounting bracket, indicated generally by reference 40 in FIGS. 1 and 2. For explanatory purposes, the mounting bracket 40 is shown in FIGS. 1 and 2 being mounted to a bottom of the heat exchanger core 14. However, the mounting bracket 40 could also be mounted to the top of the heat exchanger core 14, and in some embodiments, mounting brackets 40 may be located at both the top and the bottom of the core 14. In some example embodiments, the mounting bracket 40 may be located in the middle of the heat exchanger core and may have spacing dimples such as shown in the aforementioned U.S. Pat. No. 5,964,282 to maintain spacing within the core 14.

The mounting bracket 40 includes a mounting bracket plate 42 and at least one separately formed bracket member 44 mounted to an end of the mounting bracket plate 42. In an example embodiment, a bracket member 44 is secured to each of the opposing ends of the mounting bracket plate 42. FIG. 1 shows a bracket member 44 about to be mounted to the mounting bracket plate 42, and FIG. 2 shows bracket members 44 mounted to the opposite ends of mounting bracket plate 42.

Figures 4, 5, 6, 7, 8, 9:
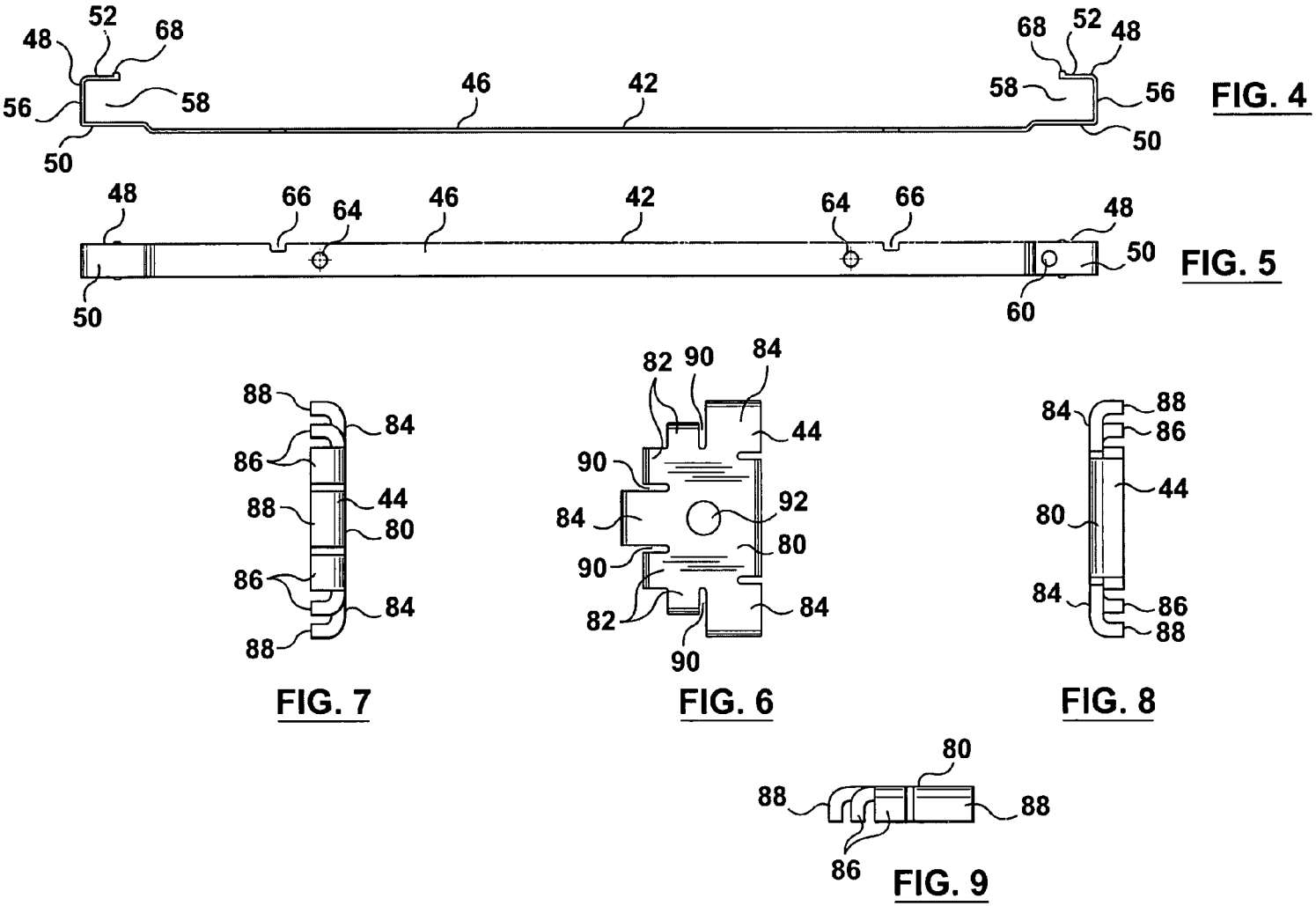
FIG. 4 is a front or elevational view of a mounting bracket plate of the mounting bracket shown in FIG. 1.
FIG. 5 is a plan view of the mounting bracket plate of FIG. 4.
FIG. 6 is a front or sectional view of a mounting bracket member of the mounting bracket shown in FIG. 1.
FIG. 7 is a side view taken from the left of FIG. 6, of the mounting bracket member.
FIG. 8 is a side view taken from the right of FIG. 6, of the mounting bracket member.
FIG. 9 is an end view taken from the bottom of FIG. 6, of the mounting bracket member.

Referring now to FIGS. 4 and 5, in at least one example embodiment the mounting bracket plate 42 is an elongate generally planar plate of unitary construction having a planar central portion 46 and opposed end portions that form bracket members 48 located at opposite ends of the planar central portion 46. Each bracket member 48 includes a first plate portion 50 that extends from the planar central portion 46, a second plate portion 52 that is spaced apart from and substantially parallel to the first plate portion 50, and an intermediate plate portion 56 that extends between and joins the first plate portion 50 and second plate portion 52. The first plate portion 50 is, in at least one example embodiment, located in a plane parallel to and offset from a plane of central portion 46. The first, second and intermediate plate portions 50, 52 and 56 have a generally C-shaped configuration that partially surround an central area or space 58.

As seen best in FIG. 2, planar central portion 46 is in contact with the bottom end fin 34. The offset first plate portions 50 are in contact with respective adjacent end bosses 28 of the final or bottom plate 16 in the core 14. First plate portions 50 are offset a predetermined distance relative to the planar central portion 46. This predetermined distance is equal to one-half the fin height of fin 34.

As seen best in FIG. 5, in an example embodiment, one of the offset plate portions 50 of mounting bracket plate 42 is formed with a flow orifice 60, and the other offset plate portion 56 is blank or closed. The flow orifice 60 can be aligned with an inlet or outlet opening 30 or 32 to allow fluid to flow through an inlet or outlet fitting 62 of the heat exchanger. The blank or closed end, on the other hand, can be used to seal the opening 30 or 32 of the boss 26 or 28 which the offset plate portion 56 contacts. In various embodiments flow orifices 60 may be provided at both ends of the bracket plate 42, one end, or at neither end. Mounting bracket plate 42 may be formed with alignment holes 64 and peripheral notches 66 to help align the components during the assembly or subassembly process.

Figure 3:
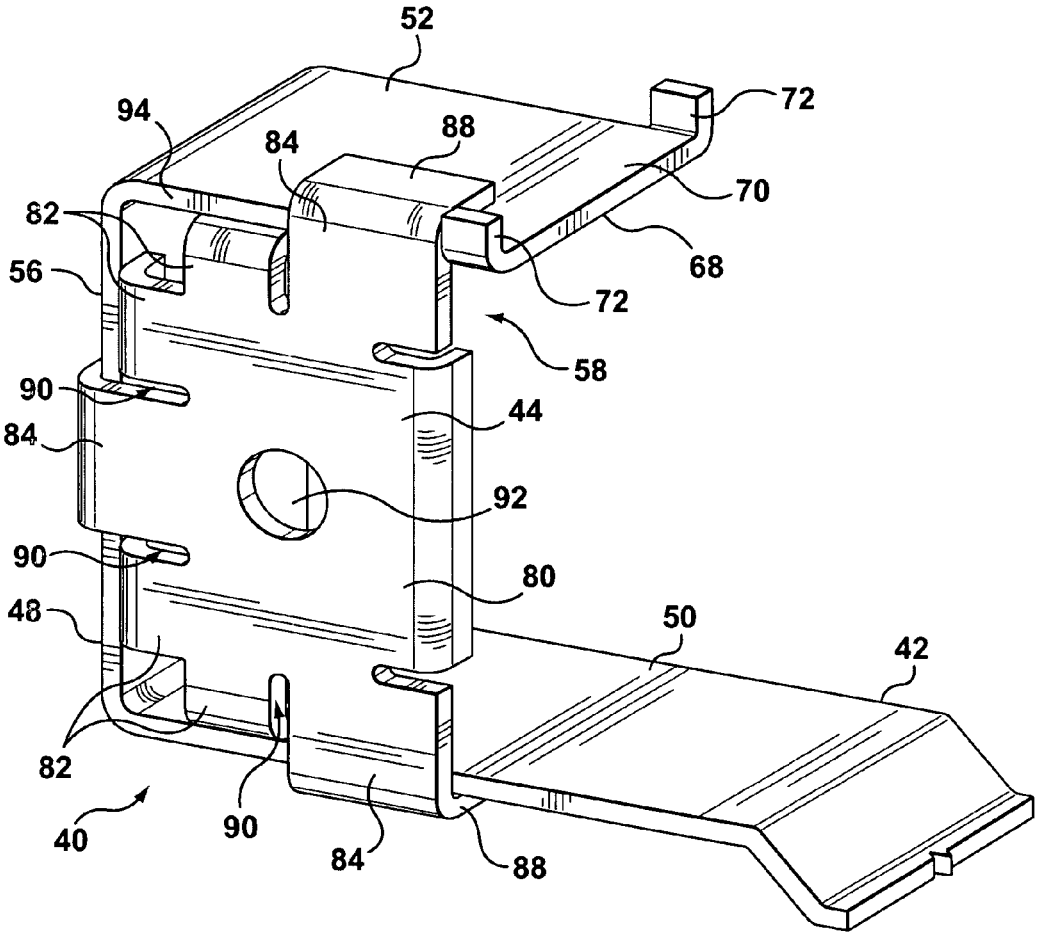
FIG. 3 is an enlarged perspective view of part of the mounting bracket shown in FIG. 1.

The opposed end bracket members 48 extend outward from the opposite side ends of the heat exchanger core 14. As best seen in FIGS. 1–3, the second plate portion 52 of each end bracket member 48 has an inwardly directed end 68 for engaging the end of an intermediate plate pair 12 in the core 14. In the illustrated example, the spacing between the first and second plate sections 50, 52 is such that end 68 engages the third plate pair 16 from the bottom of the core 14, however different spacing can be used in various embodiments. As seen in FIG. 3, the plate pair engaging end 68 has a central area 70 having a width that corresponds to a width of the end of the pate pair 16 that engaging end 68 is attached to. Flange portions 72 extend at substantially right angles from side edges of the central area 70 for engaging side edges of the plate pair that engaging end 68 is attached to. Thus, central area 70 and flange portions 72 define a three-sided channel for receiving the end of the plate pair 16.

Separate bracket member 44 is adapted to be mounted to the bracket member 48 of the bracket plate 42. With reference to FIGS. 1, 2 and 6–9, bracket member 44 has a central plate portion 80 from which a plurality of tab-like engagement members 82 and 84 extend. The engagement members 82 and 84 have respective distal end portions 86 and 88 that are each bent at approximately a right angle relative to a plane of the central plate 80. The engagement members 82 are shorter than the engagement members 84 such that when the mounting bracket member 44 is mounted to the bracket plate 42, the outer surfaces of the bent ends 86 of the shorter engagement members 84 engage the inner surface of the plate bracket member 48, and the inner surfaces of the bent ends 88 of the longer engagement members 84 engage the outer surface of the plate bracket member 48. The longer engagement members also engage the side edge 94 of the plate bracket member 48. Thus, as can be appreciated from FIG. 3, when the bracket member 44 is mounted to the plate bracket member 48, the first plate section 50 of the plate bracket member 48 is engaged on its inner surface and its outer surface by an engagement member 82 and an engagement member 84, respectively. Similarly, the second plate section 52 is engaged on its inner surface and its outer surface by an engagement member 82 and an engagement member 84 of the bracket member 44, respectively, and the intermediate plate section 54 is engaged on its inner surface by two of the shorter engagement members 82 and its outer surface by a longer engagement member 82.

The configuration of engagement members 82, allows the bracket member 44 to be clipped in place to the plate bracket member 52 and to stay in place, through a friction fit, pending a brazing operation, and helps to provide a secure, durable joint between the two bracket components, and to ensure that the bracket member 44 is properly aligned on the bracket plate 42. Narrow slots 90 may be provided between adjacent engagement members 82, 84 to provide some limited resiliency and facilitate clipping of the bracket member 44 into place. Engagement members 82, 84 could have configurations other than that shown, for example, among other possible variations, the number of members engaging each plate section 50, 52 and 56 could be different from that shown.

The center plate portion 80 of the mounting bracket 44 includes a mounting opening 92 there through for receiving a fastening component such as a rivet, bolt or shaft, among other things, in order to mount the heat exchanger 10. When the mounting bracket 44 is secured to the plate bracket member 48, the central plate portion 80 extends across the space or area 58 that is defined between the C-shaped plate-bracket member 48 and the end of the heat exchanger core.

The bracket plate 42 is in an example embodiment formed from a braze clad metal plate of a uniform thickness, the ends of which are bent to form the plate bracket members 52. The separate bracket member 44 is formed from a non-braze clad metal plate of uniform thickness, with slots 90 formed and the ends 86 and 88 bent to form the engagement members 82 and 84. The bracket plate 42 can be formed from a plate material having a different thickness than the plate material of separate bracket member 44, and in an example embodiment, the bracket member 44 is formed from a thicker material to provide additional strength around mounting opening 92. In embodiments in which the bracket member 44 is not braze clad, brazing material will generally not flow into the mounting opening 92 during brazing of the heat exchanger 10, and thus the mounting opening 92 is less likely to be distorted or altered during the manufacturing process, thereby improving manufacturing tolerances.

In an example embodiment, during heat exchanger assembly, braze-clad plate pairs 12 and fins 34 are alternating stacked together to form core 14. A final fin 34 and a mounting bracket plate 42 are then added to one or both ends of the core 14, and then mounting bracket members 44 are friction-fit mounted into place on the bracket forming ends 48 of the bracket plate(s) 42. The entire heat exchanger 10 is then placed in a brazing furnace to braze the components together.

Figure 10:
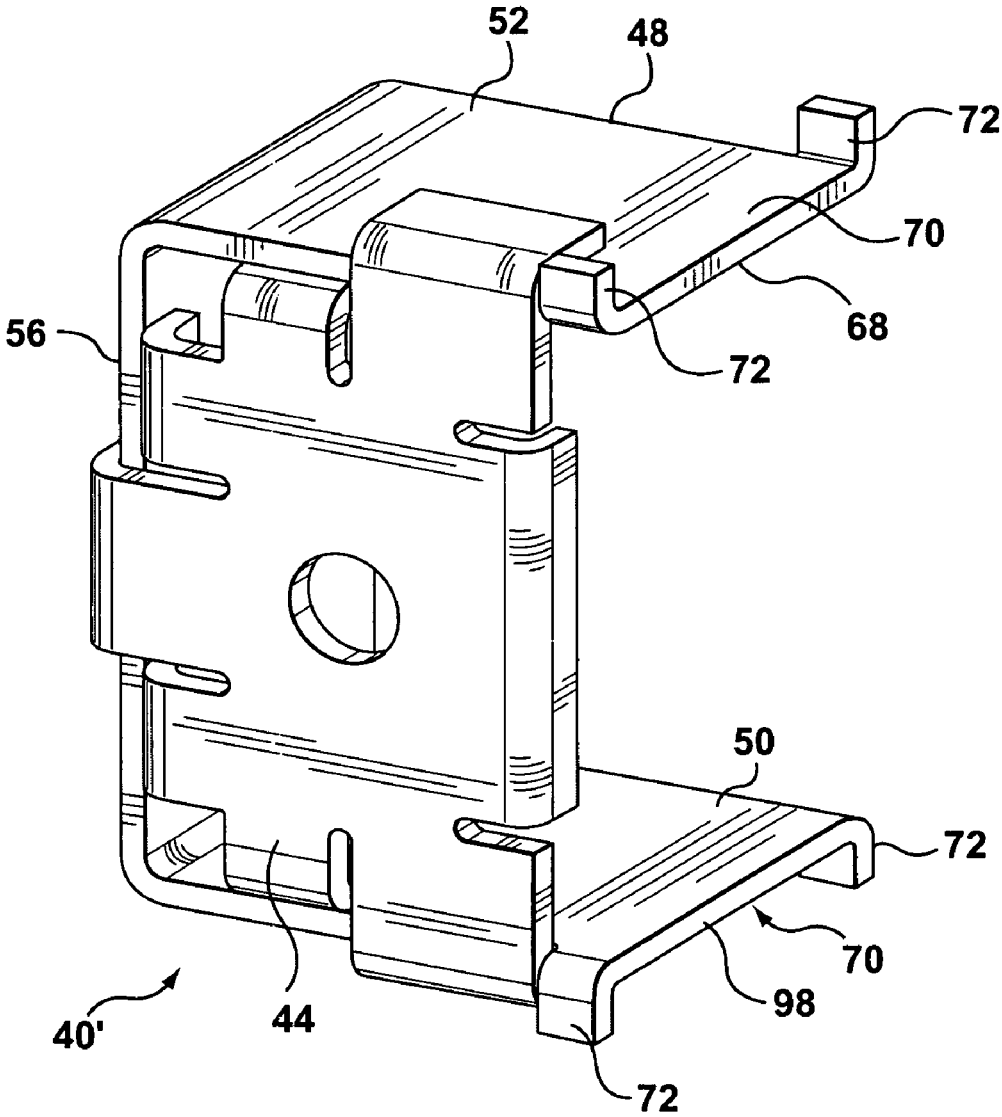
FIG. 10 is a perspective view showing another mounting bracket according to example embodiments of the invention.

FIG. 10 shows a further mounting bracket 40' according to example embodiments. The bracket 40' is similar to bracket 40, however the mounting bracket 40' does not include an elongate plate portion for securing to a bottom or top end of the core 14, but rather includes first and second ends 68, 98 for engaging the ends of respective plate pairs 12. Thus end 98 is similar to above described end 68 and includes a central portion 70 that is bounded by two flanges 72 for receiving the end of a plate pair 16.

Figure 11:
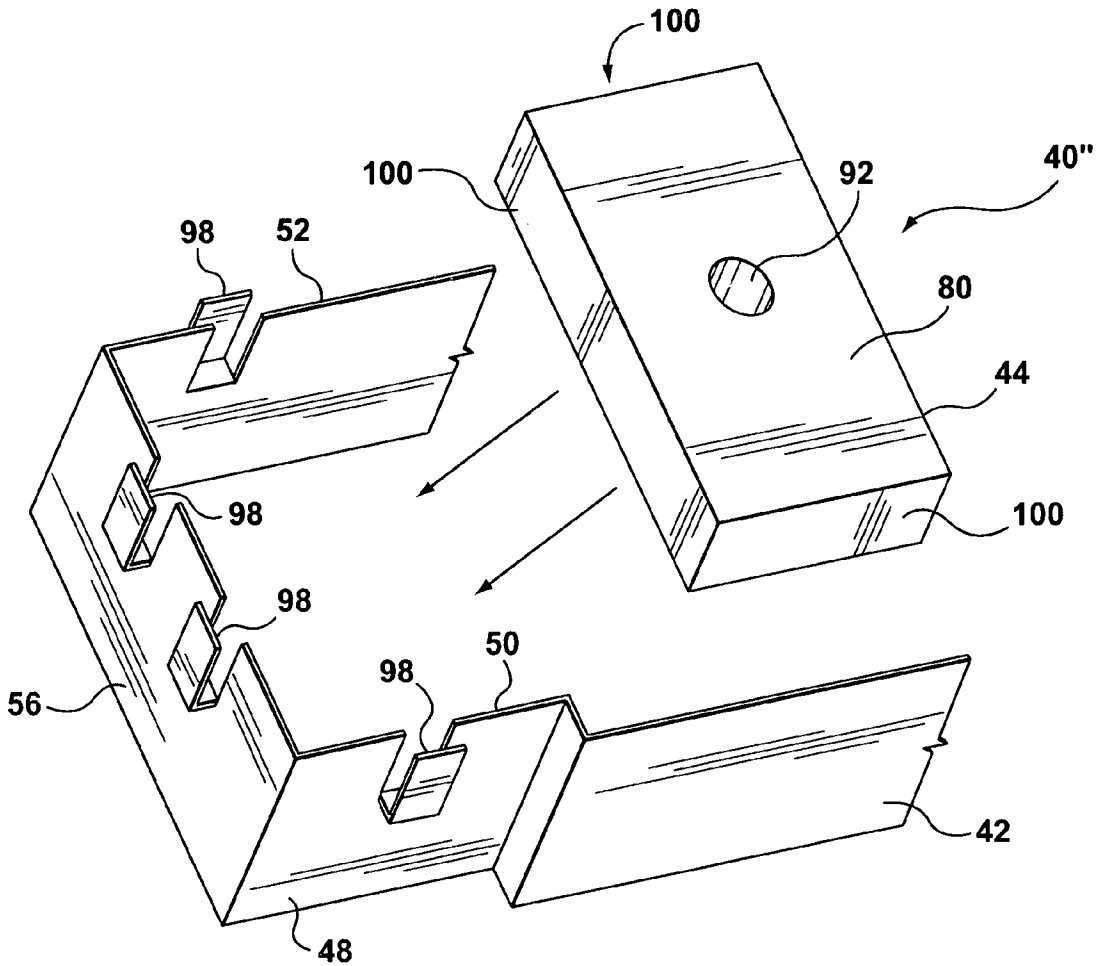
FIG. 11 is a partial perspective, exploded view, showing another mounting bracket according to example embodiments of the invention.

FIG. 11 shows a further mounting bracket 40" according to example embodiments. The bracket 40" is similar to bracket 40, however in bracket 40", the engagement members 82, 84 surrounding central plate portion 80 of the separate bracket member 44 have been replaced with sidewalls 100. More particularly, in bracket 40" at least three peripheral end portions surrounding the central portion 80 have been folded in a common direction to extend at generally right angles from the central portion 80 in order to form side walls 100 around at least three sides of the separate bracket member 44. In the plate bracket member 48, offset tabs 98 have been provided in each of the plate sections 48, 52 and 56 to provide engagement members for engaging the sidewalls 100 of the separate bracket member 44. It will thus be appreciated that various engagement configurations can be used to secure the separate bracket member 44 and the plate bracket member 48 together, pre-brazing, in various embodiments of the invention.

Finally, it is to be understood that while several preferred embodiments of the present invention are herein shown and described, it will be understood that various changes, in size and shape of parts, and otherwise, can be made. In some example embodiments, the components may be made from materials other than metal. As well, whereas the disclosure is directed primarily to the field of heat exchangers, the mounting bracket of the present invention may be used in association with any other fluid handling apparatus using plate pairs, for example, condensers, filtration devices, fuel cells and fuel reformers or processors.

The above-described embodiments of the invention are intended to be examples only. Alterations, modifications and variations may be effected to the particular embodiments by those skilled in the art without departing from the scope of the invention, which is defined by the claims appended hereto.

What is claimed is:

1. A mounting bracket in combination with a heat exchanger having heat exchanger core formed by a stack of tube members each defining an internal flow passage, the mounting bracket comprising:

an elongate, generally flat plate, the plate having an elongated planar central portion mounted to the heat exchanger core, the plate being shaped at a first end of the planar central portion to form a first bracket member having a first bracket end integrally connected to the first end of the planar central portion, a second distal end engaging the heat exchanger core at a location spaced apart from the planar central portion and an intermediate portion between the first bracket end and the second distal end that is spaced apart from the heat exchanger core, the first bracket member at least partially surrounding an opening adjacent a side edge of the heat exchanger core; and a second bracket member separately formed from and mounted to the first bracket member, the second bracket member having a central plate portion extending at least partially across the opening that is at least partially surrounded by the first bracket member, the central plate portion defining a mounting opening there through.

2. The mounting bracket of claim 1 wherein the plate is shaped at a second end of the planar central portion to form a third bracket member substantially identical and opposed to the first bracket member, and including a forth bracket member substantially identical to the second bracket member and mounted to the third bracket member.

3. The mounting bracket of claim 1 wherein the flat plate is formed from braze clad metal and the second bracket member is formed from metal that is not braze clad.

4. The mounting bracket of claim 1 wherein the second bracket member is formed from a plate material having a thickness greater than that of the first plate.

5. The mounting bracket of claim 1 wherein the second bracket member includes engagement members which extend outward from the central plate portion and engage the first bracket member thereby securing the second bracket member to the first bracket member, the engagement members including first engagement members each having ends for engaging an inner side surface of the first bracket member, and longer second engagement members each having ends for engaging at least an edge of the first bracket member.

6. The mounting bracket of claim 5 wherein the second engagement member ends include a bent portion for also engaging an outer side surface of the first bracket member.

7. The mounting bracket of claim 5 wherein the second bracket member includes a sidewall extending at an angle from a peripheral area of the central plate portion of the second bracket member, the first bracket member including plate portions having offset tab members formed therein for receiving portions of the sidewall.

8. The mounting bracket of claim 1 wherein the first bracket member has a substantially C-shaped configuration.

9. The mounting bracket of claim 1 wherein the plate has a flow orifice formed there through at one end thereof and the other end thereof is blank.

10. A heat exchanger comprising:

a stacked tube core including a plurality of stacked elongate tubes each defining an internal fluid passage and having spaced apart inlet and outlet openings in communication with the internal fluid passage, the stacked tube core including an inlet manifold communicating with the inlet openings and an outlet manifold communicating with the outlet manifolds for providing for a flow of fluid through the tubes; and a mounting bracket including (i) an elongate, generally flat mounting bracket plate mounted to the stacked tube core, the mounting bracket plate including a substantially planar central portion and being shaped at a first end of the planar central portion to form a first bracket member, the first bracket member extending from the planar central portion outward from a side of the stacked tube core and having a distal end for engaging an end of one of the elongate tubes in the stacked tube core at a location on the side of the stacked tube core spaced apart from the first end of the planar central portion, the first bracket member partially surrounding a first bracket member area adjacent the side of the stacked tube core; and (ii) a second bracket member mounted to the first bracket member, the second bracket member having a central plate portion extending at least partially across the first bracket member area, the central plate portion having a mounting opening formed there through.

11. The heat exchanger of claim 10 wherein the distal end of the first bracket member includes a central area having a width corresponding to a width of the end of the one elongate tube that is engaged by the distal end of the first bracket member, and flange portions extending at substantially right angles from opposite side edges of the central area and defining a channel therewith, the end of the one elongate tube being received within the channel.

12. The heat exchanger of claim 10 including a final tube at an end of the stacked tube core and a fin located on the final tube, wherein the mounting bracket plate includes offset end portions that are offset from the central portion of the plate a predetermined distance, the planar central portion of the mounting bracket plate being in contact with the fin and the offset end portions being in contact with respective end portions of the final tube, the first bracket member extending from one of the offset end portions.

13. The heat exchanger of claim 12 wherein the predetermined distance is equal to half the height of the fin.

14. The heat exchanger of claim 13 wherein the tubes each have mating end bosses located at opposite ends thereof forming the inlet and outlet manifolds, the end portions of the mounting bracket plate being in contact with respective end bosses of the final tube.

15. The heat exchanger of claim 14 wherein one end portion of the mounting bracket plate has a flow opening therethrough in communication with one of the inlet and outlet manifolds and the other end portion of the mounting bracket plate is blank.

16. The heat exchanger of claim 10 wherein the first bracket member is substantially C-shaped.

17. A heat exchanger comprising:

a heat exchanger core including a plurality of stacked elongate tubes each defining an internal fluid passage and having spaced apart inlet and outlet openings in communication with the internal fluid passage, the stacked tube core including manifolds communicating with the inlet and outlet openings for circuiting a flow of fluid through the internal fluid passages of the tubes; and a mounting bracket secured to the heat exchanger core comprising: (i) a unitary first bracket member including a first plate portion having a first end section secured to the heat exchanger core, a second plate portion having a second end section secured to the heat exchanger core, and an intermediate plate portion spaced apart from the heat exchanger core, the first and second plate portions being spaced apart from each other with the intermediate plate portion extending there between, the first, second and intermediate plate portions defining a C-shaped space therebetween; and a separately formed second bracket member mounted to the first bracket member and having a central portion extending at least partially across the C-shaped space, at least one of the second and first bracket members having engagement members for securing the second bracket member to the first bracket member the central portion defining a mounting opening there through.

18. The mounting bracket of claim 17 wherein the first bracket member is formed from braze-clad metal and the second bracket member is formed from non-braze clad metal.

19. The mounting bracket of claim 17 wherein the first bracket member and the second bracket member are each formed from plate material, the plate material of the first bracket member being thinner than the plate material of the second bracket material.

20. The mounting bracket of claim 17 wherein the engagement members extending outward from the central portion of the second bracket member and engaging the first bracket member, the engagement members including first and second engagement members having bent ends for respectively engaging opposite side surfaces of the first mounting bracket, the first engagement members being shorter than the second engagement members.

21. A method for forming a heat exchanger comprising steps of:

providing a heat exchanger core including a plurality of braze clad stacked tube members;

providing a braze clad generally planar bracket plate and connecting the bracket plate to the heat exchanger core, the bracket plate having a generally C-shaped first bracket member extending beyond an end of the heat exchanger core;

providing a non-braze clad second bracket member having engagement members for engaging the first bracket member and connecting the engagement members to the first bracket member, the second bracket member including a central portion defining a mounting opening therethrough; and furnace brazing the second bracket member to the first bracket member.

22. A mounting bracket for a heat exchanger, comprising:

an elongate, generally flat plate, the plate having a planar central portion for mounting to a heat exchanger core, the plate being shaped at a first end of the planar central portion to form a first bracket member, the first bracket member extending from the planar central portion and having a distal end for engaging the heat exchanger at a location spaced apart from the planar central portion, the first bracket member at least partially surrounding an opening; and a second bracket member separately formed from and mounted to the first bracket member, the second bracket member having a central plate portion extending at least partially across the opening that is at least partially surrounded by the first bracket member, the central plate portion defining a mounting opening there through, wherein the second bracket member includes engagement members which extend outward from the central plate portion and engage the first bracket member thereby securing the second bracket member to the first bracket member, the engagement members including first engagement members each having ends for engaging an inner side surface of the first bracket member, and longer second engagement members each having ends for engaging at least an edge of the first bracket member, and the second engagement member ends include a bent portion for also engaging an outer side surface of the first bracket member.

23. A heat exchanger comprising:

a stacked tube core including a plurality of stacked elongate tubes each defining an internal fluid passage and having spaced apart inlet and outlet openings in communication with the internal fluid passage, the stacked tube core including an inlet manifold communicating with the inlet openings and an outlet manifold communicating with the outlet manifolds for providing for a flow of fluid through the tubes; and a mounting bracket including (i) an elongate, generally flat mounting bracket plate mounted to the stacked tube core, the mounting bracket plate including a substantially planar central portion and being shaped at a first end of the planar central portion to form a substantially C-shaped first bracket member, the first bracket member extending from the planar central portion and having a distal end for engaging the stacked tube core at a location spaced apart from the first end of the planar central portion, the first bracket member partially surrounding a first bracket member area adjacent a side of the stacked tube core; and (ii) a second bracket member mounted to the first bracket member, the second bracket member having a central plate portion extending at least partially across the first bracket member area, the central plate portion having a mounting opening formed there through.

* * * * *